US005157415A

United States Patent [19]

Seyasu

[11] Patent Number: 5,157,415

[45] Date of Patent: Oct. 20, 1992

[54] STATIONARY THERMAL PRINTER FOR USING DETACHABLE CASSETTE

[75] Inventor: Shiro Seyasu, Tokyo, Japan

[73] Assignee: Teraoka Seiko Co., Ltd., Tokyo, Japan

[21] Appl. No.: 631,981

[22] Filed: Dec. 21, 1990

[30] Foreign Application Priority Data

Jan. 31, 1990 [JP] Japan ..... 2-9484[U]

[51] Int. Cl.[5] ..... B41J 25/304; B41J 2/32

[52] U.S. Cl. ..... 346/76 PH; 400/120

[58] Field of Search ..... 346/76 PH; 400/120

[56] References Cited

FOREIGN PATENT DOCUMENTS 63-107905 5/1988 Japan .

*Primary Examiner*—Benjamin R. Fuller
*Assistant Examiner*—Huan Tran
*Attorney, Agent, or Firm*—Sandler, Greenblum, & Bernstein

[57] ABSTRACT

The present invention provides an improved printer head for using a detachable cassette, particularly the printer head stationary mounted on a print station for using a detachably loadable cassette on the station, the cassette integrally having a webbed label together with a platen roller therein. In prior art, however, a conventional printer head is disadvantageous that a webbed label is often broken during the replacement of the cassette due to the absence of suitable locking mechanism to refuge the printer head from a platen roller so as to facilitate and ensure the safe replacement of webbed label when the cassette is replaced. In order to solve such disadvantages, the present invention provides an improved printer head capable of constantly being held at a position apart from a platen roller to refuge in the upper portion as far as no cassette is loaded on the print station. The locking mechanism is released by manually operating a lever, however, even if the manual lever is operated contrary toward wrong direction due to the user's mis-operation, however, the printer head of the present invention will return to a correct direction automatically in response to the absence of the platen roller under the printer head.

6 Claims, 5 Drawing Sheets

STATIONARY THERMAL PRINTER FOR USING DETACHABLE CASSETTE

BACKGROUND OF THE INVENTION

1. Field of the Invention

The present invention relates to a stationary thermal printer for using a detachable cassette, more particularly to a stationary thermal printer mounted on a printer body as a station for using a detachably loadable cassette on the station, the cassette integrally containing a webbed label and a platen roller therein.

2. Description of the Prior Art

Japanese Utility Model Provisional Publication No. Sho 63-107905 discloses a label printer having a printer body with a print section that performs the print work by pressing against a thermal head, i.e., pressure is formed between the printer head and a platen roller. The thermal head is biased by an elastic member so as to press against the platen roller. A cassette integrally houses the platen roller and also houses a webbed label form or printed form to be fed into the print section.

In this conventional printer, when unloading the label cassette 59 from the printer body, it is necessary to manually separate the thermal head 8 of the printed section 3 from the platen roller 7 by manually operating a lever 11. In contrast, when loading the label cassette 59 again on the printer body, it is necessary to load the cassette so as to insert an end of the label form webbed in the label cassette into a gap between the thermal head 8 and platen roller 7. In the conventional printer as noted above, however, a disadvantage is that the label form is often broken by contacting it against a sharp corner of the thermal head on the label, or the thermal head can be damaged by knocking the cassette up against the thermal head during the replacement work of the cassette, since, when taking out the cassette from the printer body, the unloading of the cassette is done by manually moving the thermal head upwardly and then unloading. However, the thermal head is often backed to the lower position even though the thermal head was once moved to the upper position. Thus, many troubles may occur during the replacement of the cassette in a conventional stationary thermal printer.

SUMMARY OF THE INVENTION

In order to solve such disadvantages of the conventional stationary thermal printer, it is a general object of the present invention to provide an improved thermal head which is capable of being constantly held at a position apart from a platen roller to reside in an upper portion as long as no cassette is loaded on the printer body. This prevents a label form from being accidentally torn by the thermal head and prevents damage to the thermal head itself, both of which often occur in the conventional system, by knocking the cassettes up against the head during the replacement of cassettes. Thus, an improved thermal head is provided which has an excellent durability and also extends the durability of cassettes used.

OBJECTS AND ADVANTAGES OF THE INVENTION

Accordingly, it is a more specific object of the present invention to provide an improved thermal head comprising an operational member provided for selecting an alternate position of the thermal head which is between a first position wherein engagement with a support member of the thermal head presses the thermal head on the platen roller and a second-position which separates the thermal head from the platen roller. The operational member is further provided so as to be movable by a first elastic member in a substantially cross direction to the direction in which the thermal head is normally biased. The thermal head is biased by a second elastic member for selecting the second position. The operational member is provided with a holding means to forcibly hold the thermal head at the first position while resisting the bias of the second elastic member. The holding means is further provided to release its holding action when the bias of the first elastic member does not act.

It is another object of the present invention to provide an improved thermal head wherein the operational member includes a slidable cam plate which is arranged on the support plate of the thermal head. The cam plate provides both a first holding section, which determines the first position at the lower end of the cam plate, and a second holding section, which determines the second position at the upper end of the cam plate. The cam plate further includes an inclined cam surface. A cam follower, which is connected with the support plate of the printer head, is engaged with the cam surface. The cam follower is alternatively positioned at the first or second holding sections while moving between both holding sections by slidably moving the cam plate. The first holding section is formed along the upper edge of the cam surface as an upwardly arced recess. A holding means for holding the cam follower at the first holding section by pushing up the cam follower and utilizing the counter bias of the second elastic member is also utilized to press the thermal head on the platen roller.

According to the present invention, when the cassette is loaded in the printer body, the thermal head is enabled to print a predetermined data or pattern on the label form while being held at the first position by using the holding means to lock the thermal head at the first position. The second elastic member effects a vertical bias through the head support plate and the cam follower by forcibly resisting the bias force of the first elastic member when the operational member is operated manually so as to select the first position.

In contrast, when the cassette is unloaded from the printer body, the thermal head is moved to the second position of the operational member, i.e., at the position where the thermal head is separated from the platen roller by using the bias force of the first elastic member. In this stage, it is noted that if the operational member is mistakenly operated toward the first position, the operational member will make the thermal head return to the second position automatically due to the absence of the bias force of the second elastic member to cause the platen roller to be biased against the thermal head.

According to the invention, therefore, it is advantageous that the present invention can provide a separated relationship between a platen roller of a detachable cassette and a stationary thermal head when loading the cassette on a station, since the thermal head is constantly at the second position when the cassette is absent from the station. Thus, the thermal head is prevented from accidentally being contacted with a print form or platen roller, thereby preventing the print form or thermal head itself from any damage.

DETAILED DESCRIPTION OF THE PREFERRED EMBODIMENT

Figure 1:
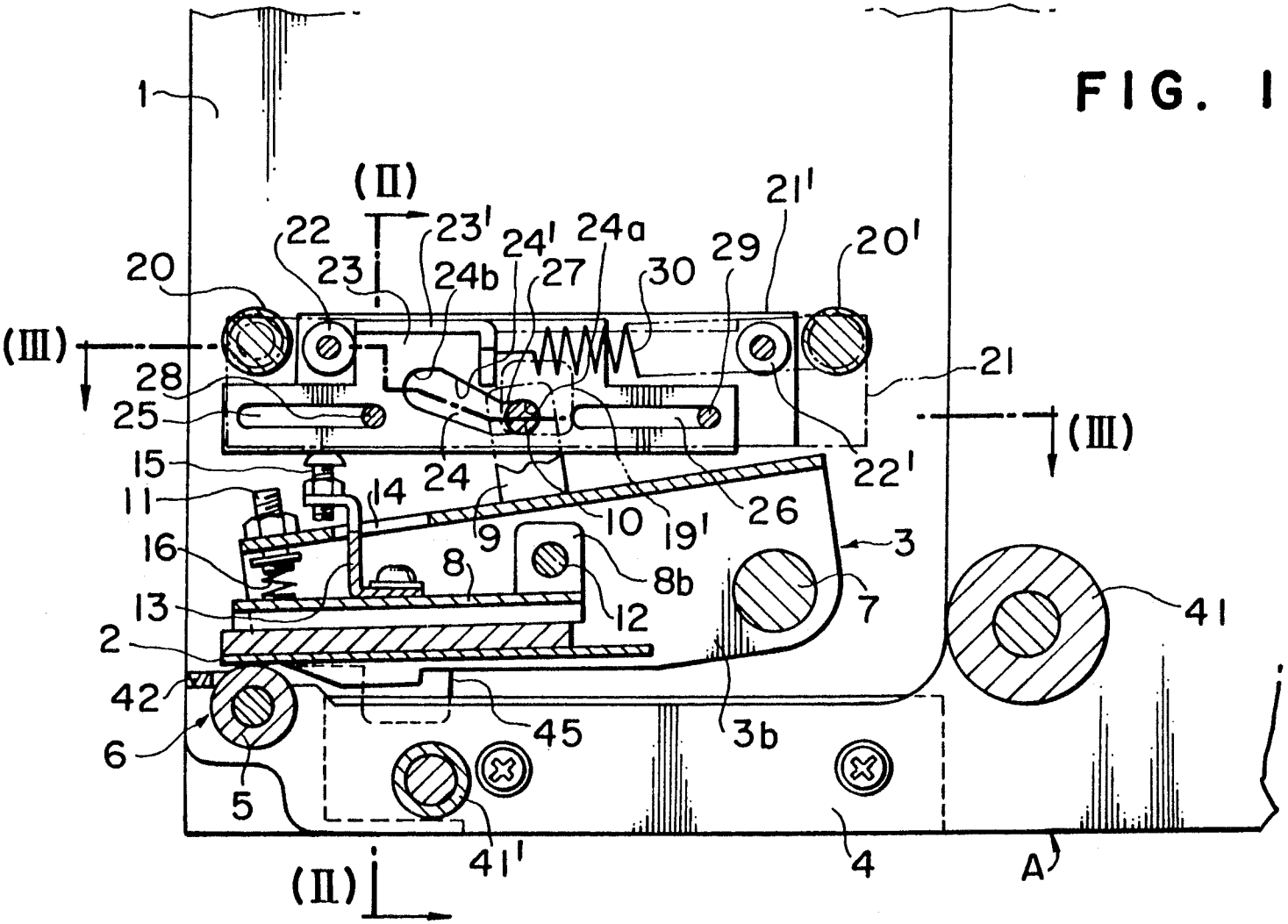
FIG. 1 is a side view illustrating a print section of the present device and also a section view of line I—I of FIG. 2.
Figure 2:
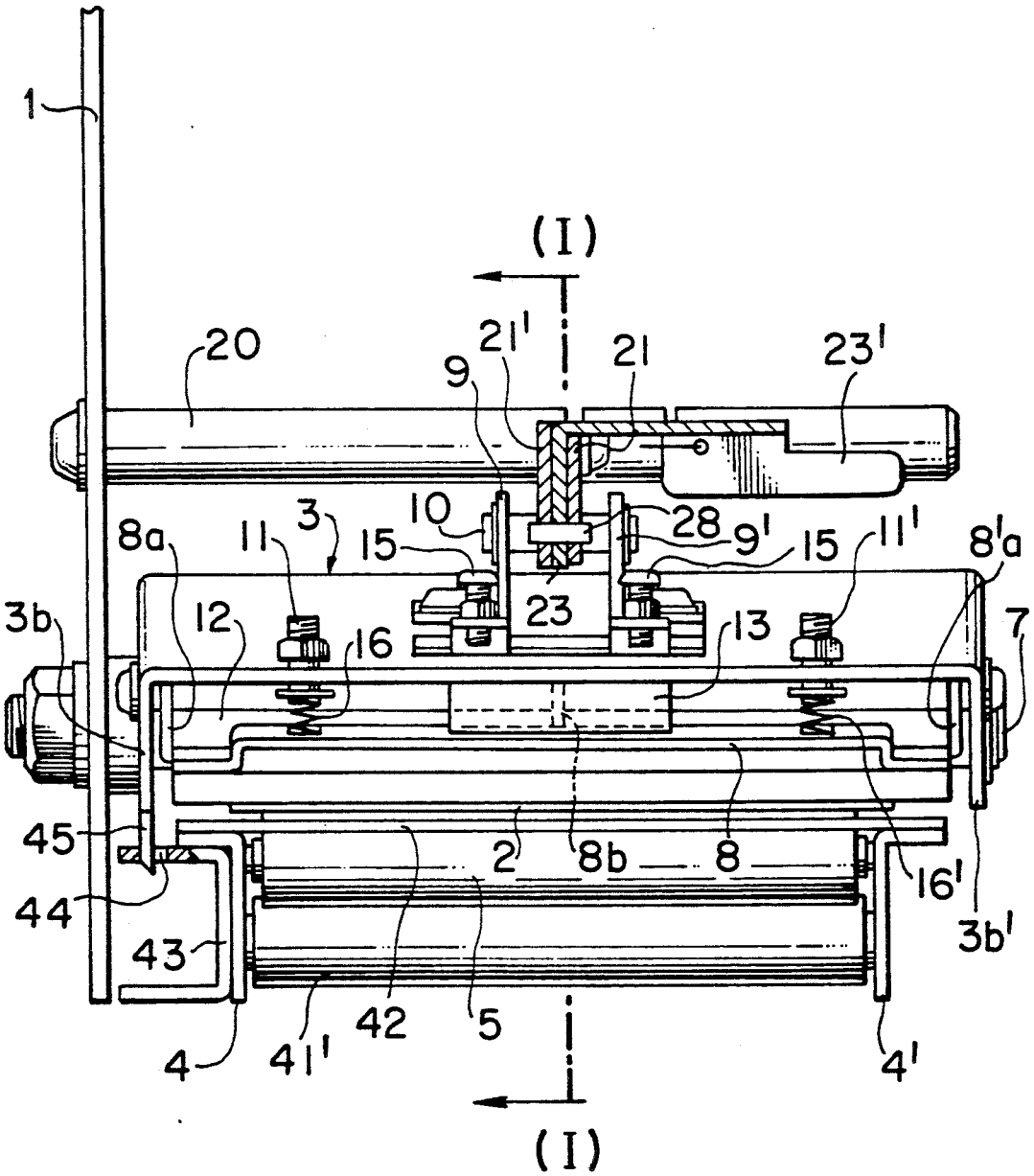
FIG. 2 is a front view illustrating a vertical section of line II—II of FIG. 1.
Figure 3:
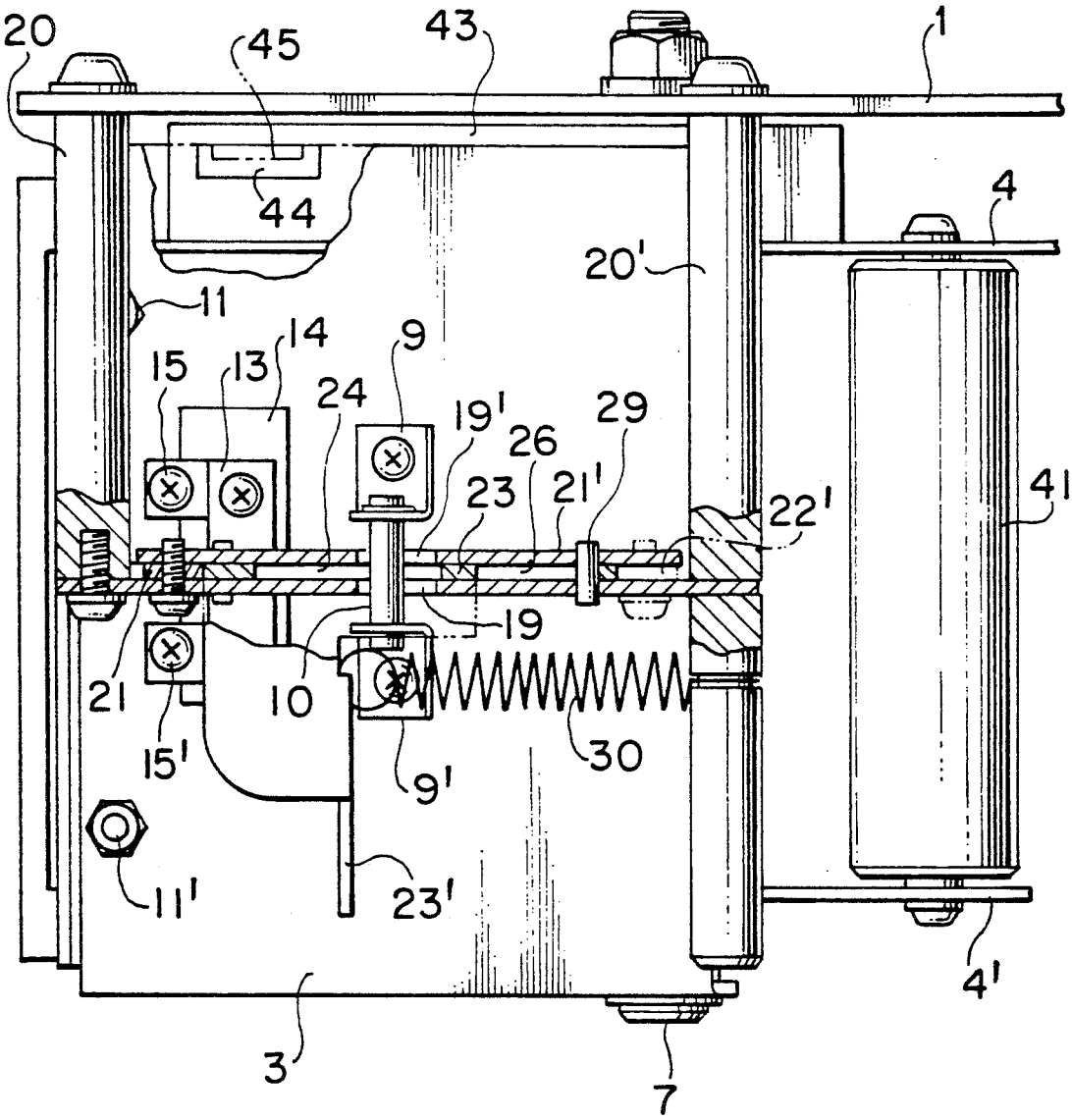
FIG. 3 is a plan view illustrating a transverse cross section of line III—III of FIG. 1.

Referring now in detail to the embodiments of the present device in accordance with the drawings, in FIG. 1 to FIG. 3, reference numeral 1 is a base plate mounted on a printer body. Thermal head 2 is mounted on base plate 1 through head support plate 3. Side plates 4 and 4' of cassette A are fixed with base plate 1. Cassette A is detachably loadable on base plate 1. Platen roller 5 extends between both ends of side plates 4 and 4', wherein it forms print section 6 in accordance with the cooperative movements of relationships between thermal head 2 and platen roller 5.

As a matter of convenience, the downstream of label issuance is referred to as the "front direction" and the upstream of the same is referred to as "rear direction" hereinafter.

Base plate 1 provides a pivot projecting where head support plate 3 is pivoted on pivot 7 to allow head support plate 3 to swing upwardly and downwardly. Head support plate 3 is formed as an inverted U-shape by bending both sides of plate 3 downwardly. Bent-down side walls include bearing surfaces 3*b* and 3*b*'. The rear portions of bearing surfaces 3*b* and 3*b*' are pivoted on pivot 7 so as to swing upwardly and downwardly. Thermal head is mounted on head support plate 3 through head fixing plate 8.

A pair of bearing brackets 9 and 9' project upright and are positioned at substantially the central portion of the upper surface of the head support plate 3. Cam follower 10 is passed through bearing brackets 9 and 9' as a pivotal pin. A pair of adjusting screws 11 and 11' are provided at the front end portion of the upper surface of head support plate 3.

In FIG. 2, thermal head 2 is mounted on the fixing surface of head fixing plate 8. The fixing surface of head fixing plate 8 has a pair of one step lower surfaces in both end portions of head fixing plate 8. Both rear side portions of head fixing plate 8 are partially bent upwardly to form a pair of bearing brackets 8*a* and 8*a*'. The rear central portion of said upper surface of head fixing plate 8 is also bent upwardly to form a bearing bracket 8*b*.

Bearing brackets 8*a* and 8*a*' provide a pair of slits which extend in the vertical direction of the brackets as idle bores so that pivotal pin 12 may be passed therethrough. The other bearing bracket 8*b* also provides a bearing bore through which pivotal pin may pass in addition to bearing brackets 8*a* and 8*a*'. Further, both ends of pivotal pin 12 are fixed with bearing surfaces 3*b* and 3*b*' of head support plate at substantially the central portion of bearing surfaces 3*b* and 3*b*'. The result is that the head fixing plate 8 swingingly pivots on pivotal pin 12 between both bearing surfaces 3*b* and 3*b*'.

A pair of L-shaped brackets 13 and 13' are also provided on the upper surface of head fixing plate 8 at substantially the central portion, for fixing a pair of stopper screws 15 and 15' on the upper portions of the L-shaped brackets 13 and 13'. The pair of stopper screws 15 and 15' may project from the ceiling of head support plate 3 by passing through a pair of slits 14 and 14' which are slit through the ceiling of head support plate. Stopper screws 15 and 15' restrict head fixing plate 8 from rotating in the counter clockwise direction by more than a predetermined angle.

Further, near the end portion of the head fixing plate 8, a pair of adjusting screws 11 and 11' are provided. A pair of coil springs 16 and 16' (i.e., the first elastic member) are provided under the bottom of head fixing plate 8 to engage with the lower ends of adjusting screws 11 and 11' so as to press thermal head 2 against platen roller 5 with a predetermined pressure.

Attached to base plate 1 are two pieces of fixing members 20 and 20' which are formed as rod shapes respectively and are positioned horizontally on the upper portion of head support plate 3 with a space between them. In FIG. 3, first guide plate 21 extends between both fixing members 20 and 20' just as a banner strung across a street. Another guide plate 21 is fixed in parallel with first guide plate 21 through two spacers or washers 22 and 22' for forming a gap between both plates 21 and 21'. Cam plate 23 is inserted into the gap formed between plates 21 and 21', and fixed slidably.

Cam plate 23 is an operational member which is slidably movable between plates 21 and 21' toward fixing member 20 or fixing member 20'. Cam plate 23 further includes lever 23' which is illustrated in FIG. 2 as an inverted L-shape in sectional view. Lever 23' is formed by partially bending the upper surface of cam plate 23.

Cam plate 23 appears as a convex shape in side view, and has three slits including a large slit 24 which has a doglegged shape and is positioned at substantially the central portion of convex shaped cam plate 23. Doglegged shape slit 24 is properly referred to as cam guide slit 24 hereinafter. The remaining two slits are formed horizontally into both sides of cam guide slit 24 along the bottom line of cam plate 23. The remaining two slits are a pair of slits and are referred to as a level guide slit 25 in the left side and level guide slit 26 in the right side hereinafter.

Cam guide slit 24 is further defined in that, in the doglegged shape of the slit, the lower end portion of cam guide slit 24 is defined as "first holding section" 24*a* and is used to position cam follower 10 at the "first position" of head support plate 3. The upper end portion of cam guide slit 24 is defined as "second holding section" 24*b* and is used to position cam follower 10 at the "second position" of head support plate 3.

The purpose of cam guide slit 24 is to suspend head support plate 3 through the pair of bearing brackets 9 and 9' by passing through the cam follower 10 a pivotal pin into the bearing bores of bearing brackets 9 and 9' through cam guide slit 24 of cam plate 23 so that cam follower 10 can move together with head support plate 3 in suspension along the doglegged slit edge formed between first holding section 24*a* and second holding section 24*b*.

In FIG. 1, in order to pass through the cam follower 10 into the cam plate 23, it is required to open a pair of holes 19 and 19' at substantially the central portions of both guide plates 21 and 21' to sandwich cam plate 23 between both guide plates as illustrated in FIG. 2.

Further, referring to cam guide slit 24, first holding section 24*a* and second holding section 24*b* should be concentric circles having almost the same diameters as that of cam follower 10 for admitting the insertion of cam follower 10 to guide the movement of the cam follower smoothly between both holding sections. Further, first holding section 24*a* includes corner projection 27 formed at an obtuse angle between first holding section 24*a* and the upward slope line of the upper edge. It is further noted that the upper edge of first holding section 24*a* is formed to curve slightly upwardly as an arc for accepting the curve of the cam follower 10.

Referring to the relationship between the pair of level guide slits 25 and 26 and both guide plates 21 and 21', it is noted that guide plates 21, 21' are connected with a pair of guide pins 28 and 29 which pass through level guide slits 25 and 26 of cam plate 23 for allowing cam plate 23 to horizontally reciprocate between both ends of the level guide slit 25 or 26 as illustrated in FIG. 1 and FIG. 3.

Next described are the first and second elastic members. A tensile type coil spring 30 (i.e., the second elastic member) is stretched between fixing member 20' and lever 23' of cam plate 23, as illustrated in FIG. 1 and FIG. 3. Thus, cam plate 23 is constantly biased toward the direction of fixing member 20' (i.e., toward the rear direction).

Figure 4:
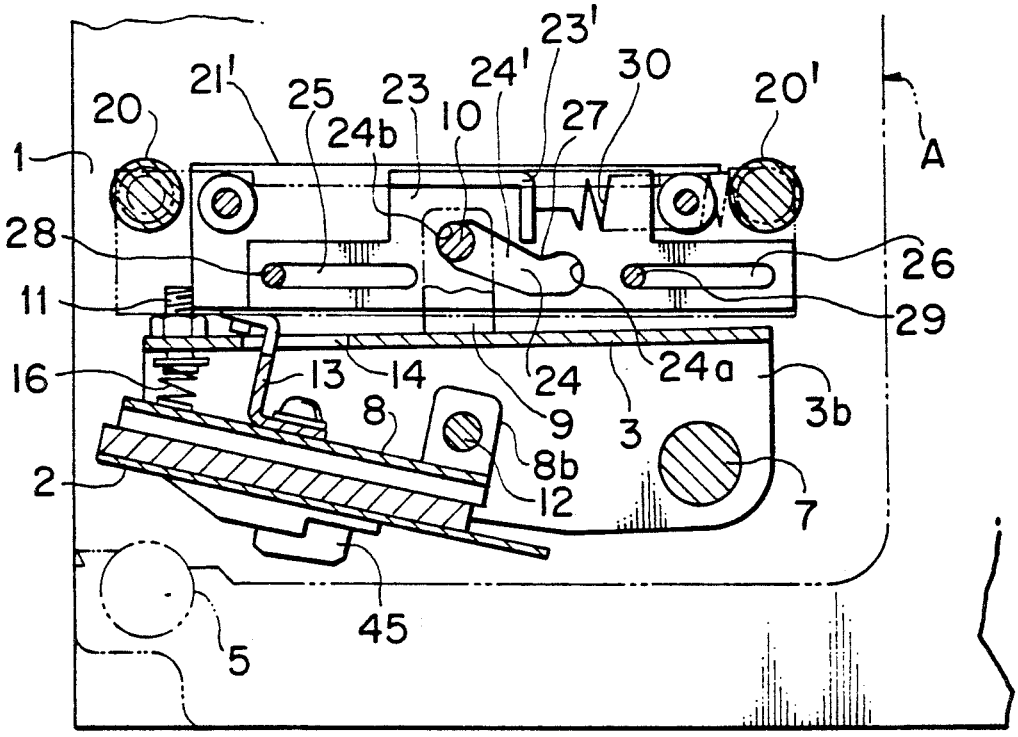
FIG. 4 and FIG. 5 are sectional side elevations for explaining the operation of the present device.

Accordingly, as illustrated in FIG. 4, when cam plate 23 is moved manually by operating lever 23' of cam plate 23, the cam follower 10 of head support plate 3 is then positioned at second holding section 24*b* of cam guide slit 24. Since only cam plate 23 is horizontally slidable between both guide plates 21 and 21' which are stationary, cam follower 10 comes to be held at the second position due to the tensile bias of coil spring 30 toward the rear direction.

Figure 5:
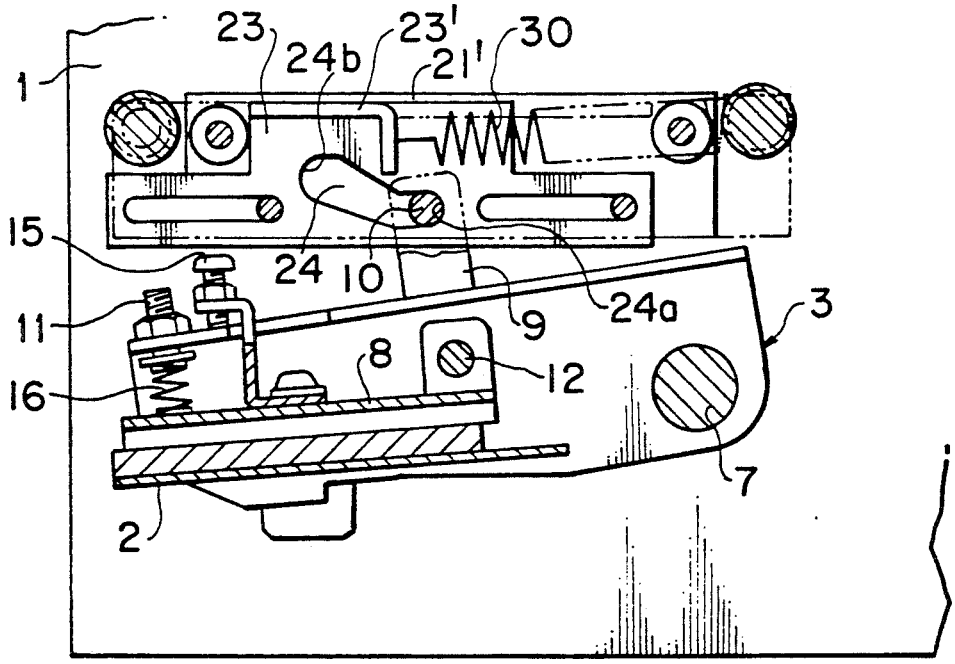

On the other hand, when cam plate 23 is moved toward the opposite side, i.e., the front direction or the direction of the fixing member 20, as shown in FIG. 5, and further, cassette A is loaded on the printer body 1 at the same time, cam follower 10 is positioned at the first position, i.e., first holding section 24*a*. Cam follower 10 is pressed downwardly together with head support plate 3 and moved along the downwardly sloped upper edge of cam guide slit 24 according to the horizontal movement of cam plate 23 toward the front direction. Head support plate 3, which is pivoted at pivot 7, is made to incline toward the front direction by the downward pressing action of cam follower 10 through the pair of bearing brackets 9 and 9' as illustrated in FIG. 5.

In FIG. 1 and FIG. 5, as a result of loading the cassette A on printer body 1, thermal head 2 comes in contact with platen roller 5, such that the thermal head 2 is pressed upwardly by platen roller 5 against the expanding bias of coil spring 16 (i.e., the first elastic member). Consequently, cam follower 10, positioned at the arc shaped first holding section 24*a*, is pushed up by the bias of coil spring 16 through pivotal pin 12, head support plate 3 and the pair of bearing brackets 9, 9', in sequence. This results in cam follower 10 being locked up at the first position and restricted from moving over corner projection 27 of the first holding section 24*a* while resisting the tension of the coil spring 30, which is biased toward the rear direction. Thus, the expanding bias of coil spring 16 comprises means for holding the cam follower 10 at the first position.

Next described is the unlocking mechanism of the means for holding in the first position the cam follower 10, i.e., when no cassette A is loaded on the printer body 1, roller 5 does not contact thermal head 2 of head support plate 3. Thus, the expanding bias of coil spring 16 is not effective and does not push up cam follower 10, as shown in FIG. 4. Consequently, cam follower 10 becomes unlocked in first holding section 24*a* and easily gets over corner projection 27 of first holding section 24*a*. Accordingly, cam follower 10 returns to the second position due to the tensile bias of coil spring 30. This is the unlocking mechanism of the means for holding the first position of cam follower 10. Summarizing the above features, the first position of cam follower 10 means the position where thermal head 2 is pushed up by platen roller 5 (as in FIG. 1), and the second position of cam follower 10 means the position where thermal head 2 is separated from platen roller 5 (as in FIG. 4).

Figure 6:
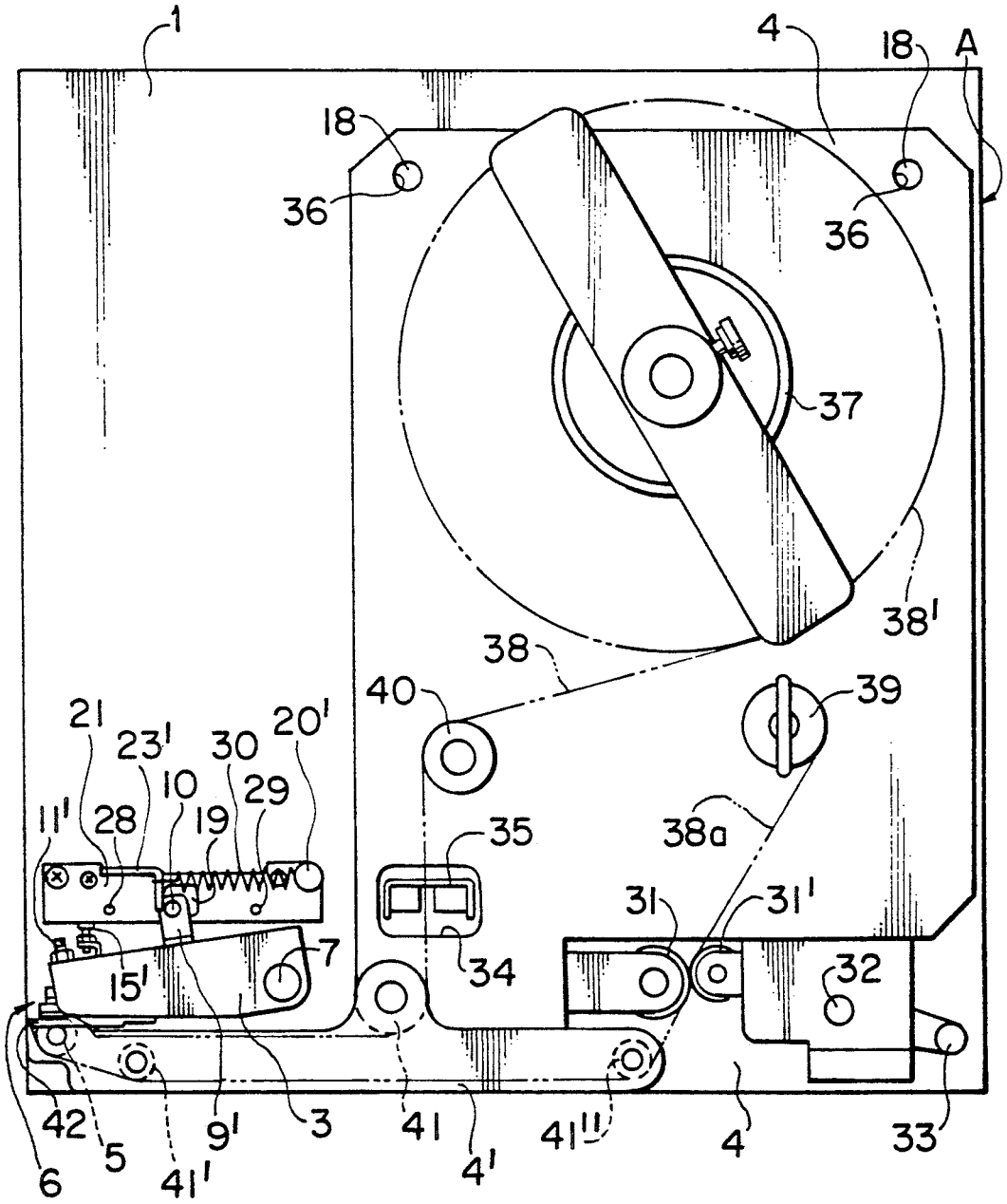
FIG. 6 is a side view illustrating the whole body with a cassette mounted.

FIG. 6 is a general view which illustrates the cassette A loaded on base plate 1. A pair of cassette supporting pins 18 and 18 are projected from the upper portion of base plate 1. Main drive roller 31 and idle roller 31' are arranged at the lower portion of base plate 1.

Main drive roller 31 is driven by a stepping motor disposed on the reverse side of base plate 1 (not shown in the drawings). Idle roller 31' and release lever 33 are mounted on both ends of a bar which is pivoted by pivotal pin 32 at substantially the central portion so as to swing the bar as a balance. Idle roller 31' is moved upwardly from main drive roller 31 by manually pushing down release lever 33 in a counter clockwise direction.

Further, in FIG. 6, both sides of cassette A are covered by a pair of side walls 4 and 4'. Peep window 34 is provided on side wall 4. Label detector 35 is arranged at a position which can be seen through peep window 34 from outside. The detecting section of label detector 35 is projected on a label running passage provided on the upper surface of side wall 4.

As an engaging means for engaging cassette A with base plate 1, side wall 4 is provided with a pair of fixing holes 36 and 36 in both upper corner portions of side wall 4, which engage with cassette supporting pins 18 and 18, as well as another engaging means. Release lever 33 is equipped with a device which locks with base plate 1 in linking motion with the movement of release lever 33 (not shown in the drawings).

Side wall 4 also provides a reel shaft 37 in its upper portion, for loading label web 38' which includes label tape 38 rolled around a reel and loaded detachably on reel shaft 37. Label tape 38 includes a plurality of labels with an adhesive on the reverse side and a lining tape to which the plurality of labels are applied with a predetermined gap between each of the labels.

Further, side wall 4 provides a shaft for a lining tape recovery reel 39 and a guide roller 40 which acts as an idle roller in the lower portion of reel shaft 37. The shaft for a lining tape recovery reel 39 is driven by a geared motor arranged at the reverse side of base plate 1 through a suitable coupling device.

In FIG. 6, cassette A is provided with another group of guide rollers 41, 41', which function as idle rollers, respectively, along the bottom line of cassette A and which extend between side wall 4 and the opposed side wall 4'. In addition, platen roller 5 is arranged at the left most end of the bottom line of cassette A and dispenser 6 is also arranged just before platen roller 5. Dispenser 6 has the purpose of separating printed labels one by one from the lining tape which is processed as a exfoliatable surface.

Another locking mechanism for locking cassette A with base plate 1 is an engaging projection 45 of head support plate 3, and its engaging slit 44 in base part 43.

In FIG. 2, as described previously, head support plate 3 consists of a flat plate portion, i.e., the ceiling portion and both side bent-down walls, i.e., both bearing surfaces 3*b* and 3*b*'. Engaging projection 45 is provided integrally so as to project a part of the bottom edge of bearing surface 3*b* as illustrated in FIG. 1 and FIG. 2. On the other hand, engaging slit 44 is provided at the upper surface of base part 43 to catch the engaging projection 45 into engaging slit 44. Base part 43 is formed as a backward C-shape in the sectional view as shown in FIG. 2, and positioned under engaging projection 45 of bearing surface 3*b* as shown in FIG. 1 and FIG. 2. During loading of cassette A on base plate 1, engaging slit 44, which belongs to the cassette side, is squeezed into position to meet with engaging projection 45 of head support plate 3 which is positioned stationary. As engagement is thus achieved, simultaneously platen roller 5, which also belongs to the cassette side, is positioned at a predetermined position against thermal head 2.

This engagement is advantageous in that it can improve not only the accuracy of print capability of thermal head 2, but also can prevent thermal head 2 from any damage caused by careless operation since it is mechanically impossible to remove the cassette A as long as platen roller 5 continues to push up thermal head 2, even if the operator carelessly attempts to remove the cassette A.

Regarding the feed path of webbed label tape 38, it is such that label tape 38 is fed from label web 38' into the print section for performances of printing between thermal head 2 and platen roller 5, through guide roller 40, detector 35, and guide roller 41. After the separation of the label from lining tape 38*a* by using dispenser 42, only lining tape 38*a* is further fed to be recovered by the lining tape recovery reel 39 by main drive roller 31 with idle roller 31'.

The process of unloading cassette A from base plate 1 requires firstly manual rotation of release lever 33 counter-clockwise and then idle roller 31' is separated from main drive roller 31 due to the balance movement based on pivot 32, wherein lining tape 38*a* is released from engagement between both rollers 31 and 31'. At the same time, the locking device equipped with release lever 33 (not shown in the drawings) is also released from engagement with the cassette side and the base plate side. Secondly, the operation for unloading cassette A from base plate 1 in sequence is as follows: cam plate 23 is moved toward the rear direction by manually operating cam lever 23' wherein cam follower 10 is moved to the second holding section 24*b* from the first holding section 24*a*, thereby separating thermal head 2 from platen roller 5. Also, engaging projection 45 of head support plate 3 is released from engaging slit 44 of base part 43. Thereafter, cassette A can be unloaded from base plate 1.

Referring now in detail to the operation of the present device, particularly to the movement of thermal head 2 in accordance with the existence of the cassette A within plate base 1 in reference to FIG. 1, FIG. 4 and FIG. 5, FIG. 1 illustrates that cam follower 10 is moved to the first holding section 24*a* of cam plate 23 by loading cassette A on base plate 1.

In this state, thermal head 2 can maintain the position required for printing a predetermined data on the label without any movement of cam plate 23 by resisting the counter bias of tensile coil spring 30, since cam follower 10 is forcibly positioned (locked) at the upwardly arc shaped recess of the first holding section 24*a* by pushing up the cam follower 10 from the expanding bias of coil spring 16 through thermal head 2 and head support plate 3. FIG. 4 illustrates that, when cassette A is unloaded from base plate 1 as described previously, cam plate 23 is moved toward the rear direction by operating cam lever 23' for positioning cam follower 10 at the second holding section 24*b* while moving cam follower 10 upwardly along cam surface 24'.

According to the upward movement of cam follower 10 along cam surface 24', head support plate 3 is slightly rotated in the clockwise direction by pivot 7, wherein the plurality of stopper screws 15 and 15' of head fixing plate 8 is lifted by the upward movement of head support plate 3 through the plurality of brackets 13 and 13, wherein thermal head 2 is made to rotate in the clockwise direction at substantially the center of pivot 12, so as to separate thermal head 2 from platen roller 5.

Accordingly, cassette A can be loaded on or unloaded from base plate 1 using the features illustrated in FIG. 4, and this state of FIG. 4 can be maintained by the tensile bias of coil spring 30, and further there is no fear of knocking the platen roller 5 or label tape 38 against thermal head 2.

FIG. 5 illustrates that if cam plate 23 is misoriented toward the wrong direction, i.e., the front direction, due to an erroneous operation of cam lever 23', even though cassette A may be absent from base plate 1, cam follower 10 is moved to first holding section 24*a* and consequently head support plate 3 is rotated in a counter-clockwise direction. Head fixing plate 8 is rotated as well, in the same direction of the former until stopper screws 15 and 15' of head fixing plate 8 contact the upper surface of head support plate 3. As described previously, however, the misoriented cam follower 10 will be automatically returned to the proper position, i.e., the second holding section 24*b* by the tensile bias of coil spring 30 due to the absence of the counter bias of coil spring 16 for pushing up the cam follower 10, because of the absence of platen roller 5 under thermal head 2 as shown in FIG. 4.

Consequently, the present device always can keep thermal head 2 in its upper position while cassette A is absent from base plate 1.

As to the structure of the cam plate 23, it is not limited to a cam plate having a cam surface, but any other well-known equivalent may optionally be used.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A stationary thermal printer comprising:

a printer body which acts as a station upon which a cassette is detachably loaded, said cassette including a platen roller;

a thermal head which forms a printed image upon contact with said platen roller;

an operational member for selecting alternative positions of said thermal head, wherein at a first position, said thermal head presses on said platen roller in engagement with a support member of said thermal head, and wherein at a second position, said thermal head does not contact said platen roller;

said operational member biased by a second elastic member to select said second position;

said thermal head provided to be biased by a first elastic member to select said first position;

said operational member further provided to be slidable substantially transverse to a direction in which said thermal head is biased by said first elastic member;

a holding means provided within said operational member to lock said thermal head at said first position utilizing a bias of said first elastic member while resisting the bias of said second elastic member; and said holding means further comprising means for releasing the holding action of said thermal head during the absence of said bias of said first elastic member acting on said holding means.

2. A stationary thermal printer according to claim 1, wherein a fixing plate of said thermal head is pivoted at one end of said fixing plate to a head support plate so as to swing upwardly and downwardly, and said head support plate is further pivoted at one end of said head support plate to said printer body at said station so as to swing upwardly and downwardly, said first elastic member being provided between said fixing plate of said thermal head and said head support plate.

3. A stationary thermal printer according to claim 1, wherein said operational member comprises a slidable cam plate arranged on an upper potion of a head support plate, wherein said cam plate provides a first holding section which determines said first position at a lower end of said cam plate and a second holding section which determines said second position at an upper end of said cam plate, said cam plate further provides an inclined cam slit, a cam follower connected with said head support plate is engaged with said cam slit, said cam follower is alternatively positioned at said first or second holding section while moving between said first and second sections by slidably moving along a cam surface of said inclined cam slit, and said first holding section being formed along an upper edge of said cam slit as an upwardly arced recess, and means for holding said cam follower at said first holding section by vertically pushing up said cam follower by utilizing a counter bias of said first elastic member which is also utilized to press said thermal head on said platen roller.

4. A stationary thermal printer according to claim 3, wherein a pair of bearing brackets is provided upright on said head support plate at almost a central portion of said head support plate, said cam follower being stretched over and between said pair of bearing brackets; said cam plate being provided with said cam slit having said cam surface along an upper edge of said cam slit, said cam slit providing said first holding section at a rear end of said cam slit and said second holding section at a front end of said cam slit, and said cam follower comprising a pivotal pin which passes through said cam slit.

5. A stationary thermal printer according to claim 4, wherein a pair of parallel guide plates are provided with a gap therebetween positioned on the upper portion so said head support plate, said cam plate being slidably movable in said gap between said pair of guide plates, one end of said second elastic member being fixed to said cam plate, and a manual lever being integrally formed with an upper end edge of said cam plate.

6. A stationary thermal printer according to claim 5, wherein one end of said second elastic member is fixed to said manual lever of said cam plate and the other end of said second elastic member is fixed to a fixing member of said pair of guide plates.

* * * * *